United States Patent [19]

Seil

[11] 4,105,324

[45] Aug. 8, 1978

[54] ELECTROPHOTOGRAPHIC APPARATUS HAVING COMPENSATION FOR REST-RUN PERFORMANCE VARIATIONS

[75] Inventor: Kenneth F. Seil, Rochester, N.Y.

[73] Assignee: Eastman Kodak Company, Rochester, N.Y.

[21] Appl. No.: 758,534

[22] Filed: Jan. 12, 1977

Related U.S. Application Data

[63] Continuation of Ser. No. 621,914, Oct. 14, 1975, abandoned.

[51] Int. Cl.[2] ..... G03G 21/00
[52] U.S. Cl. ..... 355/14; 355/69
[58] Field of Search ..... 355/14, 69, 71

[56] References Cited

U.S. PATENT DOCUMENTS

| | | | |
|---|---|---|---|
| 3,449,658 | 6/1969 | Robinson et al. | 324/32 |
| 3,575,505 | 4/1971 | Parmigiani | 355/14 X |
| 3,851,144 | 11/1974 | Hutner | 219/216 |
| 3,892,481 | 7/1975 | Schaefer et al. | 355/14 |

FOREIGN PATENT DOCUMENTS

| | | | |
|---|---|---|---|
| 1,324,851 | 7/1973 | United Kingdom | 355/3 R |

*Primary Examiner*—A. D. Pellinen
*Attorney, Agent, or Firm*—John D. Husser

[57] ABSTRACT

Electrophotographic apparatus in which changes are effected in operative substations to compensate for variation in machine performance during the transition period between a rest condition and a steady state run condition. In one embodiment a decrease in exposure directly proportional to run time and increase in exposure directly proportional to rest time are effected by resistance capacitance circuits.

6 Claims, 4 Drawing Figures

ELECTROPHOTOGRAPHIC APPARATUS HAVING COMPENSATION FOR REST-RUN PERFORMANCE VARIATIONS

This is a continuation of application Ser. No. 621,914, filed Oct. 14, 1975, now abandoned.

CROSS-REFERENCE TO RELATED APPLICATIONS

Reference is hereby made to commonly assigned, copending U.S. application Ser. No. 621,940, entitled ELECTROPHOTOGRAPHIC APPARATUS HAVING COMPENSATION FOR CHANGES IN SENSITOMETRIC PROPERTIES OF PHOTOCONDUCTORS, filed Oct. 14, 1975, now abandoned, in the name of Curtis L. Stephens and to commonly assigned, copending U.S. application Ser. No. 550,104, entitled SYNCHRONIZING CONTROL APPARATUS FOR ELECTROPHOTOGRAPHIC APPARATUS USING DIGITAL COMPUTER, filed Feb. 13, 1975 in the name of Hunt et al, now U.S. Pat. No. 4,025,186.

BACKGROUND OF INVENTION

1. Field of Invention

The present invention relates to improved electrophotographic copiers and more particularly to such copiers having apparatus for regulating one or more of the copier's operative stations to compensate for changes in the uniformity of copying results which occur during the initial periods of operation after periods of machine rest.

2. Description of Prior Art

U.S. application Ser. No. 621,940, entitled ELECTROPHOTOGRAPHIC APPARATUS HAVING COMPENSATION FOR CHANGES IN SENSITOMETRIC PROPERTIES OF PHOTOCONDUCTORS and filed Oct. 14, 1975, now abandoned, in the name of Curtis L. Stephens discloses improved electrophotographic apparatus having means for compensating for changes in sensitometric properties of reusable photoconductive insulator layers (herein also referred to merely as photoconductors) which occur with increasing cumulative usage of such photoconductors. In general this application discloses that certain photoconductors, particularly organic photoconductors, exhibit a change in sensitometric properties, e.g., a decrease in the ability to discharge electrostatic charge per given exposure, and that those changes can be determined empirically for a particular photoconductor specie and given apparatus configuration and compensated for by an increase in exposure, primary charge and/or development bias according to a predetermined program.

However, I have discovered that another predictable phenomenon operates concurrently with the changes that occur cumulatively over the photoconductor's lifespan. Specifically, we have found that after a period of non-use, or "rest," certain electrophotographic apparatus exhibit a decrease in speed (i.e., rate of electrostatic discharge per given exposure) and then, after a period of usage, or "run" return to a performance predictable according to its cumulative usage by the teachings of the aforementioned application. Whether such temporary "rest-run" shifts in performance of the apparatus results solely from sensitometric changes in the photoconductor, or from such changes in combination with other variables in the overall machine operation during transition between the rest and steady state run condition, is not fully understood. However, I have found that such temporary changes occur in a predetermined manner and can be compensated for in a manner providing increased copy quality.

SUMMARY OF INVENTION

It is therefore an object of the present invention to provide improved electrographic apparatus including structure which compensates for transitory shifts in copy characteristics occurring during an initial period of usage after a period of non-usage.

The foregoing, as well as other objects and advantages, is accomplished in accordance with the present invention by the provision in electrophotographic apparatus of means for sensing the usage/non-usage history of said apparatus during a predetermined period prior to each copy cycle and means for adjusting the function of an operative station of such apparatus in response to the usage/non-usage history of the apparatus during such prior period. In a particularly preferred embodiment of the present invention the magnitude of imagewise exposure for a copy cycle is varied in response to the usage/non-usage history during a predetermined period previous to such cycle. A particularly simple and advantageous structure for sensing and storing information of the previous usage/non-usage period and for controlling variation of an operative station(s) of the apparatus is provided in accordance with the invention in the form of a resistance-capacitance circuit which has time constants, for charging and discharging, selected to match the variation in copy characteristics effected by periods of use or non-use.

DESCRIPTION OF DRAWINGS

Other objectives and advantageous features will be apparent from the subsequent detailed description of preferred embodiments in conjunction with the attached drawings in which like numerals refer to like parts and in which.

DETAILED DESCRIPTION OF PREFERRED EMBODIMENTS

Figure 2:
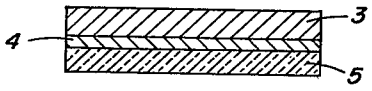
FIG. 2 is an enlarged cross section of the photoconductor web shown in the apparatus of FIG. 1.
Figure 1:
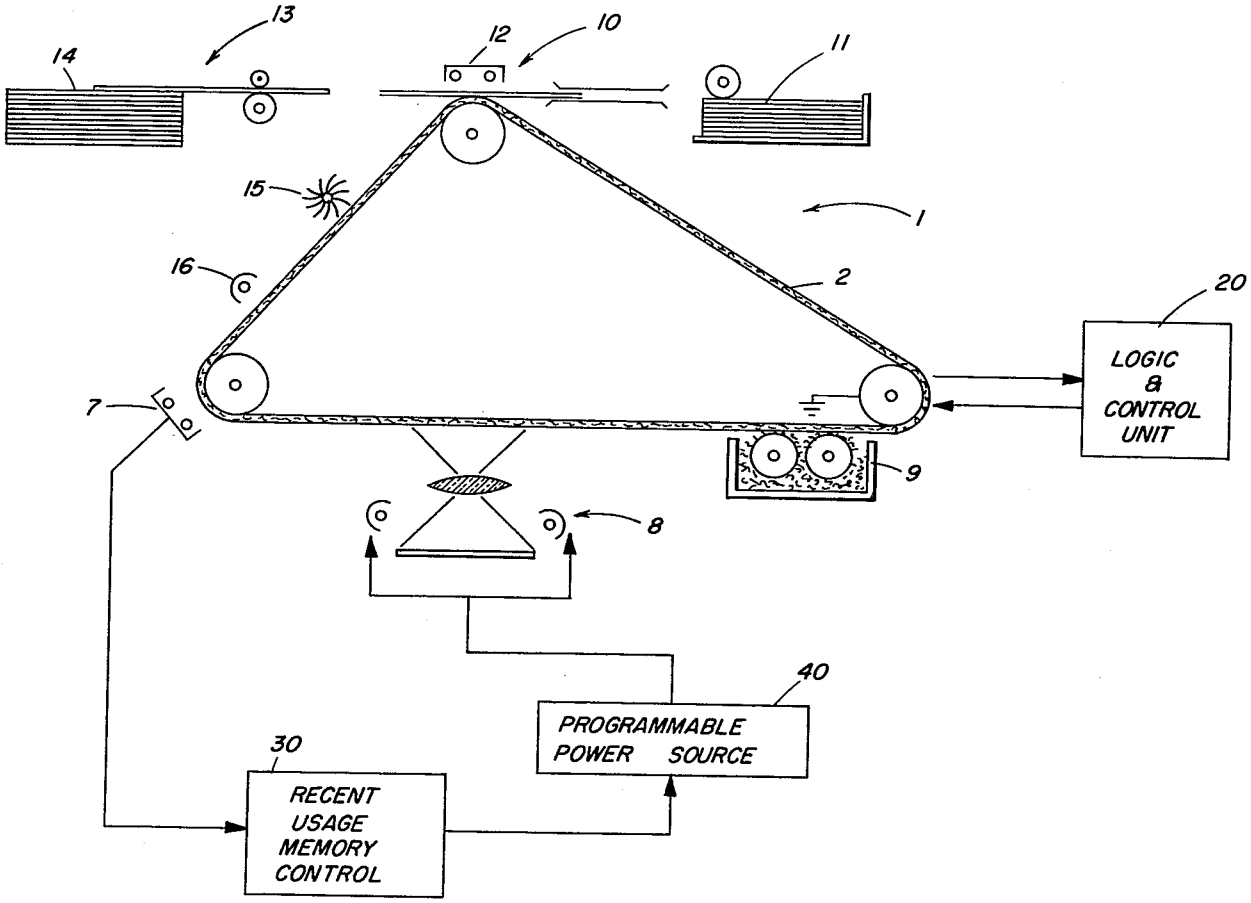
FIG. 1 is a schematic diagram illustrating one embodiment of electrophotographic apparatus in accordance with the present invention.

In FIG. 1, the electrophotographic apparatus 1 comprises a flexible imaging member 2 configured for movement around an endless path past various operative stations of the apparatus. As can be seen more clearly in FIG. 2, the imaging member 2 includes a photoconductive insulating layer 3 (e.g., of the type disclosed in U.S. Pat. No. 3,615,414) overlying a thin, electrically-conductive layer 4 both supported on a film 5. The conductive layer 4 is electrically connected to ground or other reference potential source by edge contact with rollers of the apparatus 1 or by other techniques known in the art.

Operative stations of the apparatus 1 include a primary charging station at which corona discharge device 7 applies an overall charge to the external surface of photoconductive insulating layer 3. After receiving the primary charge, an image segment of the member 2 advances past the exposure station 8 where the segment is imagewise exposed to light patterns of a document to be copied by Xenon flash lamps or other known illuminating apparatus. The latent electrostatic image then residing on the segment is next advanced over a magnetic brush development station 9 where toner is attracted to the charge pattern corresponding to dark image areas of the document. The development image is then advanced to a transfer station 10 where the toner image is transferred by corona discharge device 12 to paper, fed from supply 11.

The paper bearing the toner image is then transported through a fixing station 13, for example a roller fusing device, to a bin 14. The segment from which the toner is transferred meanwhile advances past a cleaning station 15 in preparation for another copy cycle. Erase illumination source 16 can be located after the cleaning station to dissipate residual charge prior to initiating another copy making sequence of the image segment.

As indicated schematically in FIG. 1, the cyclic operation of the various operative stations of the apparatus 1 are controlled, in proper timed relation to movement therepast of the image segments on photoconductor 2, by a logic and control unit 20. The details of such a control unit and its cooperation with apparatus such as apparatus 12 are disclosed in more detail in U.S. Pat. No. 4,025,186 entitled SYNCHRONIZING CONTROL APPARATUS FOR ELECTROPHOTOGRAPHIC APPARATUS USING DIGITAL COMPUTER, filed Feb. 13, 1975 in the name of Hunt et al, and in abandoned U.S. application Ser. No. 621,940, entitled ELECTROPHOTOGRAPHIC APPARATUS HAVING COMPENSATION FOR CHANGES IN SENSITOMETRIC PROPERTIES OF PHOTOCONDUCTORS and filed Oct. 14, 1975 in the name of Curtis L. Stephens, the disclosure of both said applications being hereby incorporated herein by this reference. The logic and control unit 20 includes a central processing unit such as are provided in commercially available programmable minicomputers and microprocessors, which receives and outputs signals to the electrophotographic apparatus 1, for regulating the operative electromechanical stations of apparatus 1.

Also as indicated in FIG. 1, the apparatus includes a recent usage memory and control 30 which receives signals from an appropriate operative station of the apparatus, here the primary charging station 7, and directs a control signal to a programmable power source 40 for the Xenon flash lamp of exposure station 8. As discussed above, the purpose of memory and control unit 30 is to adjust the function of the electrophotographic apparatus to compensate for difference between machine performance after a period of use and after a period of rest.

In the embodiment shown in FIG. 1, the memory and control unit is schematically illustrated as receiving input from the primary charging unit 7. Specifically such input can desirably be a conventional circuit which implements actuation of a relay, or other electromechanical transducer, when the primary charger is energized or de-energized. Such transducer can be utilized to move a double pole switch, such as element 31 shown in FIG. 3, from an upper position (indicated in solid lines) when the charger is not energized to a lower position (indicated in dotted lines) when the charger is energized.

Figure 3:
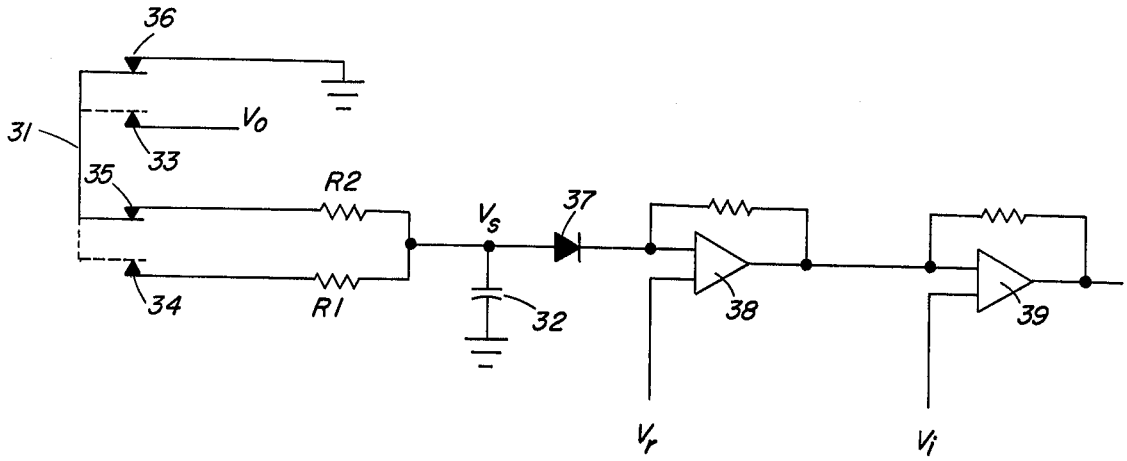
FIG. 3 is a more specific diagram illustrating one embodiment of the recent usage memory and control unit of the apparatus shown in FIG. 1.

With continued reference to FIG. 3, it can be seen that when the switch 31 is in the dotted-line position, corresponding to a use condition of the apparatus 1, a potential $Vo$ is applied to charge capacitor 32 via contacts 33 and 34 and a resistance element $R_1$. Conversely when switch 31 is in the solid-line position, corresponding to a rest condition of the apparatus 1, the capacitor 32 discharges to ground via resistance $R_2$ and contacts 35 and 36. It can thus be seen that the voltage on the line side of the capacitor at any particular time, designated the signal voltage $Vs$, will depend on the time constant of capacitance element 32 and resistance $R_1$, or of element 32 and resistance $R_2$. This signal voltage $Vs$ is applied via one way diode 37 to one terminal of differential input amplifier 38. A reference voltage $Vr$ is applied to the other terminal of amplifier 38 and an output signal proportional to the difference between $Vr$ and $Vs$ is applied to summing amplifier 39, which modifies the illumination reference voltage $Vi$ by combination with the output of 38. The output from amplifier 39 provides power to the illumination source, e.g., to the charging capacitor of a conventional Xenon flash lamp pack.

Considering the operation of this circuit, it will be seen that after a long rest condition, for example overnight, capacitor 32 will be effectively completely discharged; and upon commencement of machine operation will begin to accumulate charge at a rate dependent of the values selected for voltage $Vo$ and resistance $R_1$. As the machine continues to operate, the exposure of the photoconductor by lamps at exposure station 8 will gradually be decreased, the increasing (with continuing machine use) values of signal voltage $Vs$ being subtracted from voltage $Vr$, which affected the exposure during the initial operation after rest. It will likewise be apparent that should machine operation cease for a rest period, either of long or short duration, the voltage $Vs$will gradually decrease at a rate depending on the value selected for resistance $R_2$, as capacitor 32 discharges, and that the cumulative decrease in $Vs$ during a rest period, eventually will effect an increase in the output of amplifier 38 and a resulting increased level of exposure to the photoconductor.

Considering the foregoing it will be appreciated that the values of resistances $R_1$ and $R_2$ should be selected, in connection with the other elements of the circuit, in accordance with observed variations in performance after different rest and run periods. By way of specific example, apparatus generally as shown and described with regard to FIG. 1, having a steady state exposure of approximately 97 ergs/cm$^2$, has been used incorporating organic photoconductor of the type described in Example 2 of U.S. Pat. No. 3,615,414, more specifically a photoconductor comprising a multiphase aggregate photoconductor composition including a continuous phase containing a solid solution of an organic photoconductor, i.e., 4,4' bis(diethylamino)-2,2'-dimethyltriphenylmethane, and an electrically insulating polymer binder phase, i.e., Lexan 145, polycarbonate sold by General Electric Corporation, having dispersed therein a discontinuous phase comprising a finely divided particulate cocrystalline complex of (i) at least one polymer having an alkylidene diarylene group in a recurring unit, i.e., Lexan 145 polycarbonate, and (ii) at least one pyrylium-type dye salt, i.e., 4-(4-dimethylaminophenyl)-2,6-diphenyl thiapyrylium fluoroborate. It has been found particularly desirable to select the value of $R_1$ (in connection with other circuit element parameters) to provide a decrease in exposure of about 0.08 Log E units for about every 8.2 minutes of run time to select the value of $R_2$ (in connection with other circuit element parameters) to provide an increase of about 0.08 Log E units for every 1.2 hours of rest time. The uniformity of copy output (e.g., consistency in rendition of detail and background density level) during such transitory period after rest has been noted substantially improved over that of similar apparatus without the incorporation of the present invention. Thus, it will be appreciated that improved results are obtained in accordance with the present invention by adjustment in accordance with the rest-run/speed-variation characteristic of such apparatus. After substantial continued use, the apparatus will reach a steady state of performance and the value of capacitor should be selected (in connection with other circuit element parameters) to provide no further increase in voltage *Vs* after continuous charging for the particular run period of the machine necessary to reach this steady state condition.

It will also be appreciated that element parameters can be selected to provide for proper compensation of apparatus performance for rest-run conditions between the limits of complete effective discharge of capacitor 32 (long rest) and maximum charge on capacitor 32 (long run), the charging and discharging cycles being perfectly synchronized with cycles of machine operation and rest.

It will of course be understood that other circuits could be implemented to effect, in accordance with the present invention, the type of control described. Also, activating signals for such usage memory control circuits could emanate from other operative stations of the apparatus as, for example, directly from logic and control unit 20. Further the compensating control of the present invention can be effected by means of other operative stations of apparatus 1, e.g., by raising the primary charge in direct proportion to run time and lowering that charge in direct proportion to rest time or by lowering the bias of the development station in direct proportion to run time and raising that bias in direct proportion to rest time. Such compensation via other stations of the apparatus could be alone or in combination. Compensation for other apparatus characteristics can be implemented in combination with the compensation of the present invention, examples of these last mentioned alternatives being subsequently described with respect to FIG. 4.

Figure 4:
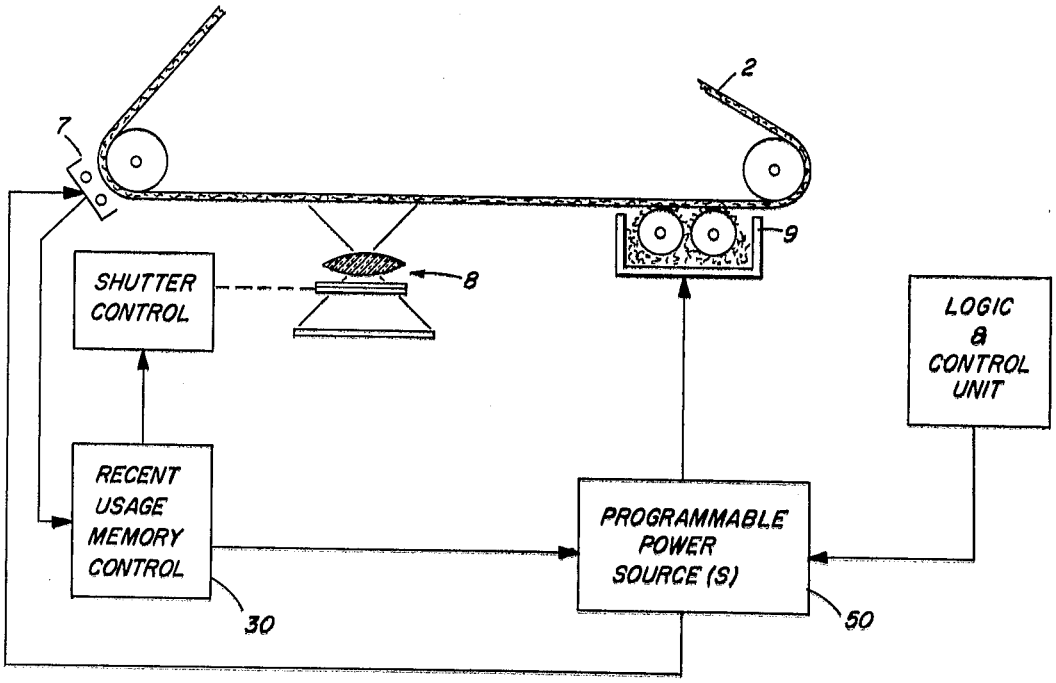
FIG. 4 is a schematic diagram similar to FIG. 1 showing an alternative embodiment of electrographic apparatus in accordance with the present invention.

In FIG. 4, an electrophotographic apparatus of the same type described with reference to FIG. 1, is shown and control means for implementing rest-run compensation in accordance with the present invention in combination with total cumulative photoconductor usage compensation, such as described in the aforementioned Stephens application, is schematically illustrated. Specifically, in this embodiment the output signal from recent usage memory and control 30 is applied to a programmable power source 50 which likewise receives a cumulative usage compensation signal from logic and control unit 20. The signals from control units 20 and 30 are combined by conventional techniques, for example using operational amplifiers, and modify the power sources for primary charger 7 and magnetic brush 9 to accomplish appropriate variation in the primary charge or development bias as described above. As pointed out the control can be utilized with one or more operative stations or in various combinations, e.g., cumulative usage compensation being effected at one station and rest-run compensation at another.

FIG. 4 also illustrates an alternative embodiment for regulating exposure to compensate for rest-run variations. In this embodiment an output is provided from control 30 to vary the time, rather than magnitude of exposure, by means of a conventional electronic shutter mechanism and timing circuit. In this embodiment, the threshold voltage of the shutter timing circuit is lowered by a resistance capacitance circuit such as shown and described with reference to FIG. 3, in proportion to run time and increased in proportion to rest time, to effect changes in exposure of time-magnitude rate such as previously described.

The invention has been decribed in detail with particular reference to preferred embodiments thereof, but it will be understood that variations and modifications can be effected within the spirit and scope of the invention.

I claim:

1. In electrophotographic apparatus of the type using a photoconductive insulative member and including charging, exposing and developing stations which are energized and function cyclically during a usage period in production of copies and which are non-energized during non-usage periods between copy production; the improvement comprising:

(a) means responsive to the cyclic function of said apparatus for storing the usage/non-usage history of said apparatus during a recent interval preceding a given copy cycle;

(b) means, responsive to said storing means, for providing an adjustment signal in accordance with the rest-run/speed-variation characteristic of said apparatus; and (c) means for adjusting the function of at least one of said stations during said given copy cycle in response to said adjustment signal to compensate for an increase in apparatus speed during a usage period and decrease in apparatus speed after a non-usage period.

2. In electrophotographic apparatus of the type having a photoconductive insulative member and including charging, exposing and developing stations which perform functions on that member during each run cycle of copy production and have rest intervals between such run cycles; the improvement comprising:

(a) monitoring means, actuable by rest and run of said apparatus, for storing information representative of the rest-run history of said apparatus with regard to a period recently previous to a current copy cycle and for providing adjustment signals based on said information and on the rest-run/speed-variation characteristics of said apparatus; and (b) means coupling said monitoring means and at least one of said stations for adjusting the function of said one station in response to said adjustment signals to compensate for speed increases of said apparatus during a period of successive run cycles and a speed decrease in said apparatus during a period of successive rest intervals.

3. In electophotographic apparatus of the type including means for uniformly electrostatically charging a photoconductive insulator member, means for exposing the member to an imagewise pattern of radiation to form an electrostatic latent image and means for developing the latent image by application of toner, the improvement comprising:

monitor means for sensing and storing information indicative of the extent of apparatus usage and non-usage in a recently previous period and for providing an adjustment signal in response to such information and in accordance with predetermined rest-run/speed-variation characteristics of said apparatus; and control means, coupling said monitor and exposing means, for adjusting the magnitude of image exposure in response to said adjustment signals to compensate for an increase in apparatus speed during a usage period and decrease in apparatus speed after a non-usage period.

4. In electrophotographic apparatus of the type including means for uniformly electrostatically charging a photoconductive insulator member, means for exposing the member to an imagewise pattern of radiation to form an electrostatic latent image and means for developing the latent image by application of toner, the improvement comprising:

means, operatively associated with said exposing means for sensing the extent of usage and non-usage of said apparatus in a period prior to a given copy cycle and for modifying the magnitude of exposure for said given copy cycle in accordance with the apparatus usage and non-usage history previous to such cycle, said sensing and modifying means including resistance-capacitance circuit means for increasing exposure in direct proportion to the extent of apparatus non-usage during a predetermined period immediately prior to said given cycle of operation.

5. In electrophotographic apparatus of the type having a photoconductive imaging member and a plurality of operative stations including charging, exposing and developing stations which cooperatively function during a cycle of operation in production of a copy; the improvement comprising:

(a) capacitance means;

(b) first circuit means, including first resistance, for charging said capacitance means in response to apparatus operation;

(c) second circuit means, including a second resistance, for discharging said capacitance means in response to apparatus rest; and (d) means, responsive to the potential of said capacitance means for regulating an operative station of said apparatus.

6. The invention defined in claim 5 wherein a parameter of said first circuit means is matched to a time varying change in the apparatus occurring during initial operation after rest and a parameter of said second circuit means is matched to a time varying change in the apparatus occurring during a period of rest.

* * * * *